US007545101B2

(12) United States Patent
Hick et al.

(10) Patent No.: US 7,545,101 B2
(45) Date of Patent: Jun. 9, 2009

(54) MULTI-ZONE CLOSED LOOP DAYLIGHT HARVESTING HAVING AT LEAST ONE LIGHT SENSOR

(75) Inventors: Robert L. Hick, Newberg, OR (US); Richard A. Leinen, Wilsonville, OR (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 328 days.

(21) Appl. No.: 11/381,980

(22) Filed: May 5, 2006

(65) Prior Publication Data

US 2006/0279225 A1 Dec. 14, 2006

Related U.S. Application Data

(60) Provisional application No. 60/677,919, filed on May 5, 2005.

(51) Int. Cl.
*H05B 37/00* (2006.01)

(52) U.S. Cl. ..... 315/149; 315/157; 315/158; 315/159

(58) Field of Classification Search ..... 315/149, 315/155, 156, 157, 158, 159; 250/214 AL
See application file for complete search history.

(56) References Cited

U.S. PATENT DOCUMENTS 5,668,446 A * 9/1997 Baker ..... 315/294
7,019,276 B2 * 3/2006 Cloutier et al. ..... 250/214 AL
2006/0076908 A1 * 4/2006 Morgan et al. ..... 315/312

* cited by examiner

*Primary Examiner*—David Hung Vu
(74) *Attorney, Agent, or Firm*—Marger Johnson & McCollom, P.C.

(57) ABSTRACT

A multi-zone daylight harvesting method and apparatus having a closed loop system utilizing a single light sensor is disclosed herein. This light control system includes an ambient light sensor connected to a detection circuit for detecting the amount of ambient light within a given zone and converting the light signal to an digital one. A control device couples to receive a predetermined rate of change for each respective zone from a storage unit along with the converted digital signal. The control device connects each zone of a plurality of electrical loads to control the power supplied to the electrical load at the predetermined corresponding rate of change and responsive to the amount of ambient light detected.

13 Claims, 2 Drawing Sheets

MULTI-ZONE CLOSED LOOP DAYLIGHT HARVESTING HAVING AT LEAST ONE LIGHT SENSOR

This application claims the benefit of the filing date of a provisional application having Ser. No. 60/677,919 which was filed on May 5, 2005.

FIELD OF THE INVENTION

The present invention relates to light control systems, and, more particularly, to a multi-zone closed loop daylight harvesting having at least one light sensor.

BACKGROUND OF THE INVENTION

Daylight harvesting is an available lighting strategy designed to reduce excessive internal light levels during peak consumption hours, wherein external light sources, such as daylight, substitute for interior electrical lighting. For example, in an office setting, each work area must at all times be provided with a minimum level of light which is determined based upon the tasks performed in the area or zone. Lighting, however, is generally installed by size and number sufficient to provide the minimum light level under the assumption that no other light sources are available in the interior space. Yet, during varying times of the day, other light sources may illuminate the interior space such that the level of light present is excessive. Thereby, the use of interior lighting at the same level of intensity becomes a waste of energy.

Specifically, during the day, sunlight may enter through windows and skylights. When these external light sources are present, the preset brightness of interior lighting is not necessary since these external light sources provide some or all of the minimum light level required. Daylight harvesting eliminates the excessive level of intensity of interior lighting, conserving as much as 84% of the energy required to light a facility at the minimum light level. As such, during midday, excess electrical lighting is minimized and bright sunlight is utilized to provide up to 100% of illumination during midday, when energy costs are highest.

Daylight harvesting also provides a constant level of light on work surfaces to avoid moments when the external light sources provide an excessive amount of light, resulting in periods of glare. In the alternative, when light levels are low (i.e. when clouds roll in or nighttime falls), daylight harvesting maintains this constant level of light by continuously increasing and decreasing the power applied to the internal lighting. This practice enables the worker to resolve images with ease. As a result, eyestrain is avoided; and health and productivity are promoted.

Conventional technology for implementing daylight harvesting techniques incorporates the use of digital photo-sensors to detect light levels and dimmers to automatically adjust the output level of electric lighting for promoting balance. Dimming control circuits, as implemented with respect to daylight harvesting, gradually increase or decrease interior lighting in response to photocell measurement of ambient light levels.

There are two kinds of light sensors are available. The "open-loop" sensor is positioned within a lighting system such that the sensor monitors the amount of light outside of a nearby window or skylight to read only the amount of light coming into the interior space from outside. The open loop sensor may be located within the interior space or outside of the interior space. The other kind of light sensor is called a "closed-loop" sensor. It generally is positioned on the ceiling, facing downward towards a horizontal work-surface. This sensor reads the light reflected from the horizontal work-surface. As the lights dim or brighten in response to a signal generated by the sensor, the system is adjusted to maintain a desired lighting level.

For interior spaces having one zone of lighting, the aforementioned closed-loop system is adequate. Within a closed loop system, one sensor, such as a photocell, couples to a dimmable control unit to control a multiple number of attached electrical loads, such as internal light sources, within one zone. In this zone, all internal light sources are dimmed at the same pre-determined rate of change in response to an increase or decrease in ambient light.

Adjusting all the internal light sources at the same rate is acceptable given the assumption that the external light sources affect every area of the internal space in the same way at all times of the day. However, for interior spaces that have, for example, windows along one side of the wall, the areas closest to the windows receive a higher amount of light than areas further from the windows. In such cases, a daylight harvesting scheme will require more than one zone, each having a number of internal light sources, wherein the rate for dimming the internal light sources within each zone differs. There, however, is no known closed loop system that is able to control lighting sources in multiple zones.

Open loop systems, however, may be used in the implementation of daylight harvesting for an interior space having multiple zones. Open loop systems include a light system for a specific interior space, a light control circuit or sensor and an external source of light. As mentioned above, the light control circuit is placed in a location inside or outside of the specific interior space. The light control circuit measures the external source of light. This measurement is fed back into the system to control the interior light sources, whereby, an outside source alone, i.e., the sun, controls the system output. The sun, in effect, acts as a potentiometer controlling the lighting control system. This type of system, however, suffers from less accurate control than closed loop systems because of seasonal and weather changes.

Thus, a need exists for a multi-zone daylight harvesting method and apparatus having a closed loop system that uses a single photocell or sensor to control a plurality of light sources in a plurality of zones.

The present invention is directed to overcoming, or at least reducing the effects of one or more of the problems set forth above.

SUMMARY OF THE INVENTION

To address the above-discussed deficiencies of multi-zone daylight harvesting methods and apparatus, the present invention teaches a multi-zone daylight harvesting method and apparatus having a closed loop system utilizing a single photocell.

The design of the present invention permits a single sensing and control circuit to be connected directly to a plurality of internal light sources to control these sources of light. The use of a single sensing and control circuit as described herein is particularly desirable since this method reduces cost and enhances reliability. In addition, a single sensing and control circuit will provide more uniform control of lights in a given area such as in a single room.

A light control system in accordance with the present invention includes an ambient light sensor connected to a detection circuit for detecting the amount of ambient light within a given zone. A control device connects between the detection circuit and multiple zones of electrical loads to control the power supplied to the electrical load based on the amount of ambient light detected. Each one of the zones includes a defined rate of change for adjusting the brightness of the electrical loads associated with each respective zone.

Advantages of this design include but are not limited to a multi-zone daylight harvesting method and apparatus having a closed loop system that uses a single photocell or sensor to control a plurality of light sources in a plurality of zones that employs a high performance, simple, and cost effective design.

These and other features and advantages of the present invention will be understood upon consideration of the following detailed description of the invention and the accompanying drawings.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete and will fully convey the scope of the invention to those skilled in the art.

Figure 1A:
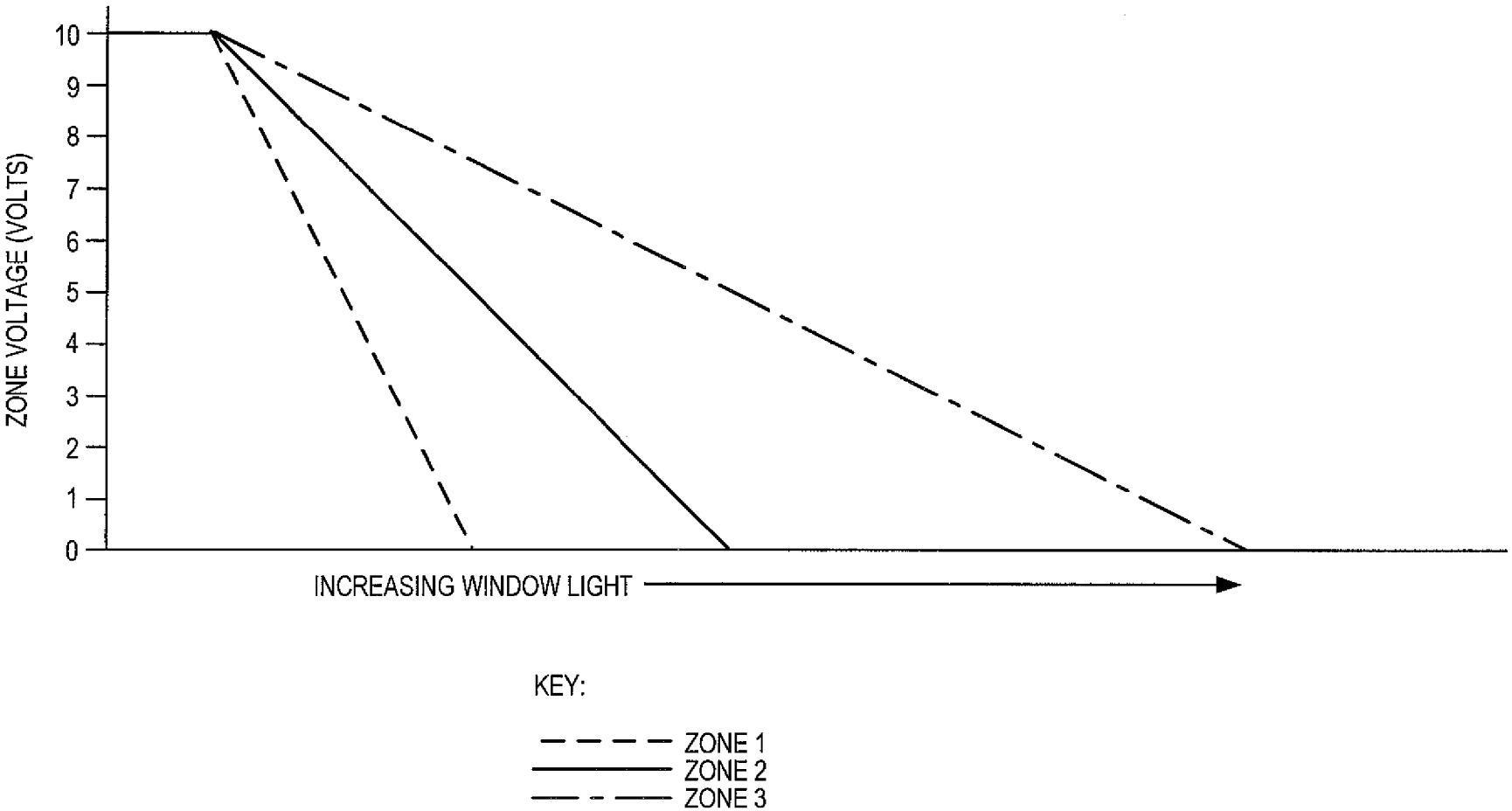
FIG. 1A show a graph of the zone voltage as a function of the increasing external light in accordance with the present invention.
Figure 1B:
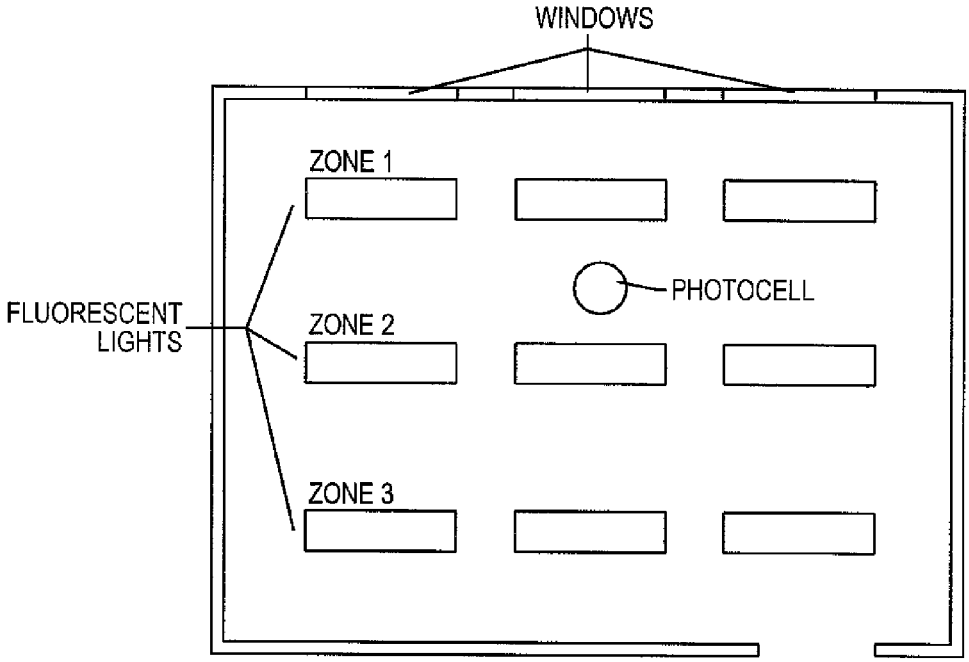
FIG. 1B displays an implementation of a three zone network of internal lighting wherein one photocell detects the ambient light for all three zones in accordance with the present invention.

This invention describes an apparatus and method for allowing a daylight harvesting controller, within a closed loop system, to control more than one zone with a single photocell. FIG. 1A displays a graph of the zone voltage as a function of the increasing external light in accordance with the present invention. FIG. 1B displays the corresponding layout of a three zone network of internal lighting wherein one photocell detects the ambient light for all three zones. As shown in FIG. 1B, zone 1 represents the plurality of light sources closest to the windows that receives the most light. When the external lighting increases at the window, the light sources of zone 1 must decrease rapidly as oppose to the rate of decrease of intensity in the light sources of zone 2 and zone 3. Accordingly, the defined rate of change for zone 1 is higher than that of zone 2 and zone 3. In the same relation, the light sources in zone 2 are closer to the external light source at the window than the light sources in zone 3. Therefore, the defined rate of change for zone 2 is higher than that of zone 3. In particular, as shown in FIG. 1B, the light sensor or photocell may be located at any position within the interior space of the room.

Figure 2:
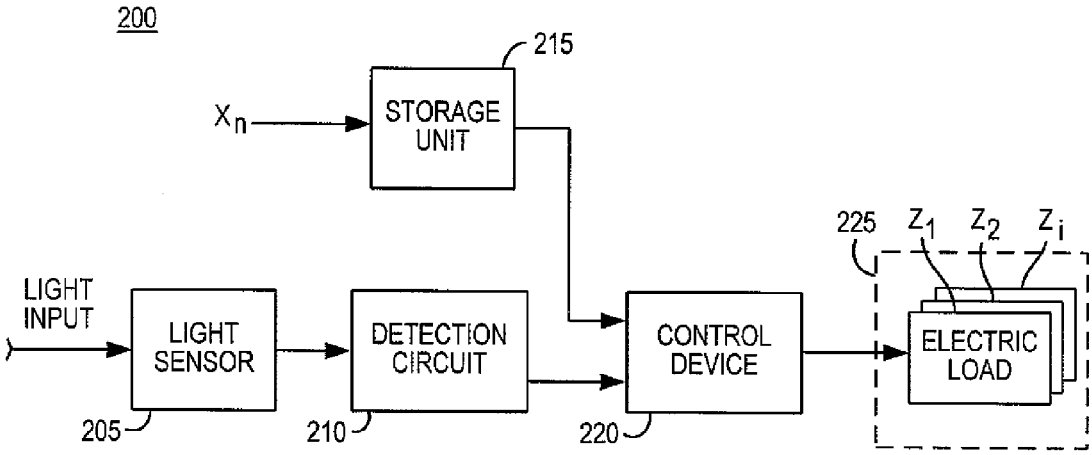
FIG. 2 displays the multi-zone light control system in accordance with the present invention.

FIG. 2 displays the multi-zone light control system 200 in accordance with the present invention. The system includes a light sensor 205, a detection circuit 210, a storage unit 215, a control device 220, and one or more electrical loads 225. When light sensor 205 is exposed to light, it produces a small current or signal. The strength of the signal is proportional to the amount of light or illumination level sensed. Detection circuit 210 is connected to sensor 205 to receive the signal generated by light sensor 205 and converts the light energy into an electrical signal. In addition, detection circuit 210 may amplify the signal to a workable level to control the indirectly connected electrical loads 225 through control device 220. The electrical loads 225 may be an electrical light source or a plurality of electrical light sources $Z_i$ (where i=1, 2, 3 . . . ). Storage unit 215 is connected to control device 220 for storage of each respective rate of change variable $X_n$ (where n=1, 2, 3, . . . ) corresponding to each zone. For example, in a three zone daylight harvesting control system, storage unit 215 couples to receive rates of change, $X_1$, $X_2$, and $X_3$, which represent the first, second, and third rate of change for a first zone $Z_1$, a second zone $Z_2$, and a third zone $Z_3$, respectively. The storage unit 215 may be implemented in software using memory or in hardware using an electromechanical device such as a potentiometer. Control device 220 is coupled to storage unit 215 and receives these stored rates of change, $X_1$, $X_2$, and $X_3$, from storage unit 215. Control device 220 adjusts the power supplied to the electrical load 225 in each respective zone, $Z_1$, $Z_2$, and $Z_3$, responsive to the detected ambient light measurement from light sensor 205. The respective rates, $X_1$, $X_2$, and $X_3$, are used to control the various zones, $Z_1$, $Z_2$, and $Z_3$, through respective connections between each zone, $Z_1$, $Z_2$, and $Z_3$, and the control device 220. A microprocessor may be used to implement the control device.

Thus, the light control system in accordance with the present invention provides adjustments for each zone $Z_i$ wherein a rate of change $X_n$ for which the zone is determined. This rate of change $X_n$ corresponds to the rate at which each internal light source must change its illumination in maintaining the proper balance for daylight harvesting in each zone $Z_i$. For example, in a three zone system as shown in FIG. 2, the installer may want the zone closest to windows to change the fastest, the middle zone to change at half the rate and the far zone to dim at a quarter of the rate.

The design of the present invention therefore permits a single sensing and control circuit to be connected directly to a plurality of internal light sources to control these sources of light. The use of a single sensing and control circuit as described herein is particularly desirable since this method reduces cost and enhances reliability. In addition, a single sensing and control circuit will provide more uniform control of lights in a given area such as in a single room. Because of ambient light variation within areas, and because of variations in calibration and response between multiple sensing and control circuits, internal light sources in the same area that are controlled by different sensing and control circuits may exhibit variation in light output. This continual variation may be annoying to persons working in the area. Thus, it is preferable to use a single sensing and control circuit to control all the lamps in a lighting zone $Z_i$.

Those of skill in the art will recognize that the physical location of the elements illustrated in FIG. 1*b* can be moved or relocated while retaining the function described above. For example, the photocell may be positioned at any point within the interior space of the room to sense ambient light for the daylight harvesting control system in accordance with the present invention.

It is understood that these rates may change given the type of weather conditions that are present. For example, on a cloudy day verses a clear day, the rate of change should differ.

The rates of change, however, may remain consistent across multiple zones since each zone is affected by the change in weather conditions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

We claim:

1. A light control system for controlling the brightness of a plurality of electrical loads, comprising:

an ambient light sensor that outputs a first signal in response to being exposed to a radiation source for sensing the ambient light level;

a detection circuit coupled to the light sensor to generate a second signal from the first signal;

a control device coupled to receive the second signal from the detection circuit to control the plurality of electrical loads; and at least two zones of the plurality of electrical loads coupled to the control device, each of the at least two zones having a different corresponding predetermined rate of change for adjusting the brightness of the corresponding zone of the plurality of the electrical loads responsive to the ambient light detected.

2. A light control system as recited in claim 1, wherein the at least two zones includes a first zone, a second zone and a third zone, the first zone having a first predetermine rate of change, the second zone having a second predetermined rate of change, and a third zone having a third predetermined rate of change.

3. A system comprising:

a storage unit to store a first rate of change and a second rate of change, wherein the first and second rates of change are different; and a control device coupled to the storage unit;

wherein the control device is to change the brightness of a first light source in a first zone at the first rate of change in response to a change in ambient light detected by a light sensor; and wherein the control device is to change the brightness of a second light source in a second zone at the second rate of change in response to the change in ambient light detected by the light sensor.

4. The system of claim 3 wherein the first rate of change is proportional to the change in ambient light detected by the light sensor.

5. The system of claim 3 wherein the first and second rates of change are proportional to the change in ambient light detected by the light sensor.

6. The system of claim 3 wherein the storage unit comprises a memory to enable software to access the first and second rates of change.

7. The system of claim 3 wherein the storage unit comprises an electro-mechanical device to store the first and second rates of change.

8. The system of claim 7 wherein the electro-mechanical device comprises one or more potentiometers.

9. The system of claim 3 further comprising a light sensor coupled to the control device.

10. The system of claim 9 further comprising a detection circuit coupled between the light sensor and the control device.

11. The system of claim 9 wherein the light sensor is arranged to sense light only from an exterior source.

12. The system of claim 9 wherein the light sensor is arranged to sense light from an exterior source and the first light source.

13. The system of claim 9 wherein the light sensor is arranged to arranged to sense light from an exterior source, the first light source, and the second light source.

* * * * *